United States Patent [19]

Quarterman

[11] Patent Number: 4,751,874

[45] Date of Patent: Jun. 21, 1988

[54] BLAST WAVE CHOKE

[76] Inventor: Edward A. Quarterman, 2284 Evans St., Livermore, Calif. 94550

[21] Appl. No.: 926,509

[22] Filed: Nov. 3, 1986

[51] Int. Cl.[4] ..... F24F 11/00

[52] U.S. Cl. ..... 98/33.1; 98/39.1; 98/119

[58] Field of Search ..... 98/32, 33.1, 37, 39.1, 98/42.01, 81, 119, DIG. 2; 109/1 S

[56] References Cited

U.S. PATENT DOCUMENTS

| | | | |
|---|---|---|---|
| 2,347,895 | 5/1944 | Evans | 98/37 |
| 3,093,056 | 6/1963 | Rosenfeld | 98/DIG. 2 X |
| 3,132,666 | 5/1964 | Nelson | 98/DIG. 2 X |
| 3,523,483 | 8/1970 | Serbin | 98/119 X |

FOREIGN PATENT DOCUMENTS

| | | | |
|---|---|---|---|
| 304751 | 4/1955 | Switzerland | 98/DIG. 2 |

*Primary Examiner*—Harold Joyce

*Attorney, Agent, or Firm*—H. Michael Brucker

[57] ABSTRACT

A blast wave choke to be disposed at the above ground entrances of a ventilation system for a underground personnel shelter wherein a plurality of annular choke elements of progressively smaller inside diameter are aligned along a common axis and spaced one from the other by annular interposed spacer elements wherein each spacer element has an inside diameter that is greater than the adjacent choke elements wherein a blast wave entering the ventilation system will encounter a series of rings and set up an interference pattern which will dissipate the energy of the blast wave before it can enter the underground shelter and cause injury to persons or damage to property therein.

10 Claims, 3 Drawing Sheets

BLAST WAVE CHOKE

BACKGROUND OF THE INVENTION

The present invention relates generally to personnel shelters for use in the event of a nuclear attack and in particular to a device to prevent a blast wave which accompanies a nuclear explosion from entering the personnel shelter through the ventilation system and causing injury to the personnel and damage to equipment within the shelter.

An earth covered personnel shelter constructed with reinforced concrete and having as its principle construction feature a corrugated steel arch will maintain its integrity even if subjected (from a nuclear blast) to a peak over pressure of about six pounds per square inch (864 pounds per square foot).

Because it is anticipated that it may be necessary to remain within such a personnel shelter for an extended period of time, it is, of course, a requirement of such a shelter that it include a ventilation system connecting the underground space with the atmosphere above. The intake section of the ventilation system is necessarily located above ground and is a potential entry point for a blast wave associated with a nuclear explosion. If the blast wave is permitted to enter into the ventilation system beyond the above ground intacke section, it will at the very least destroy the filter system which filters out radioactive particles from the air being drawn into the shelter and could result in injury to persons and damage to instruments within the shelter.

The present invention traps the blast wave within the blast wave chokes which are within the above ground intake and exhaust sections of the ventilation system. This trapping is accomplished by interference patterns set up as the blast wave strikes one concentric element after the other.

BRIEF DESCRIPTION OF THE INVENTION

In order to establish an interference pattern in any blast wave that enters the intake section of the ventilation system of an underground personnel shelter, a series of annular choke elements of decreasing inside diameter are disposed within the generally cylindrical intake of the ventilation system with the choke elements of greatest diameter closest to the intake opening. The annular choke elements are separated by interspersed annular spacer elements wherein the inside diameter of the spacer elements are greater than the inside diameter of the choke elements to which they are immediately adjacent. The choke elements and the spacer elements are all aligned along a common axis with the choke elements having radial side walls which are generally parallel to that axis. This arrangement of parts creates a series of annular edges of decreasing diameter which a blast wave will encounter as it travels down the blast wave choke. The annular edges formed by the choke elements create blast wave interference patterns within the chokes that interfere with the travel of the blast wave and dissipate its energy before it moves down into the shelter.

In addition to the choke elements and spacer elements located within the intake, an open-ended cylinder acting as a blast deflector is disposed circumjacent the intake and spaced therefrom with a portion of the blast deflector surrounding a portion of the intake and the remainder of the deflector extending beyond the intake opening. This blast deflector is effective in shielding the intake opening from any blast wave except one directed almost directly along the axis of the intake itself.

The combination of the blast deflector and the blast choke elements provides a personnel shelter with a blast wave choke protection from blast waves entering the ventilation system and causing destruction within the shelter.

DETAILED DESCRIPTION OF THE INVENTION

Figure 1:
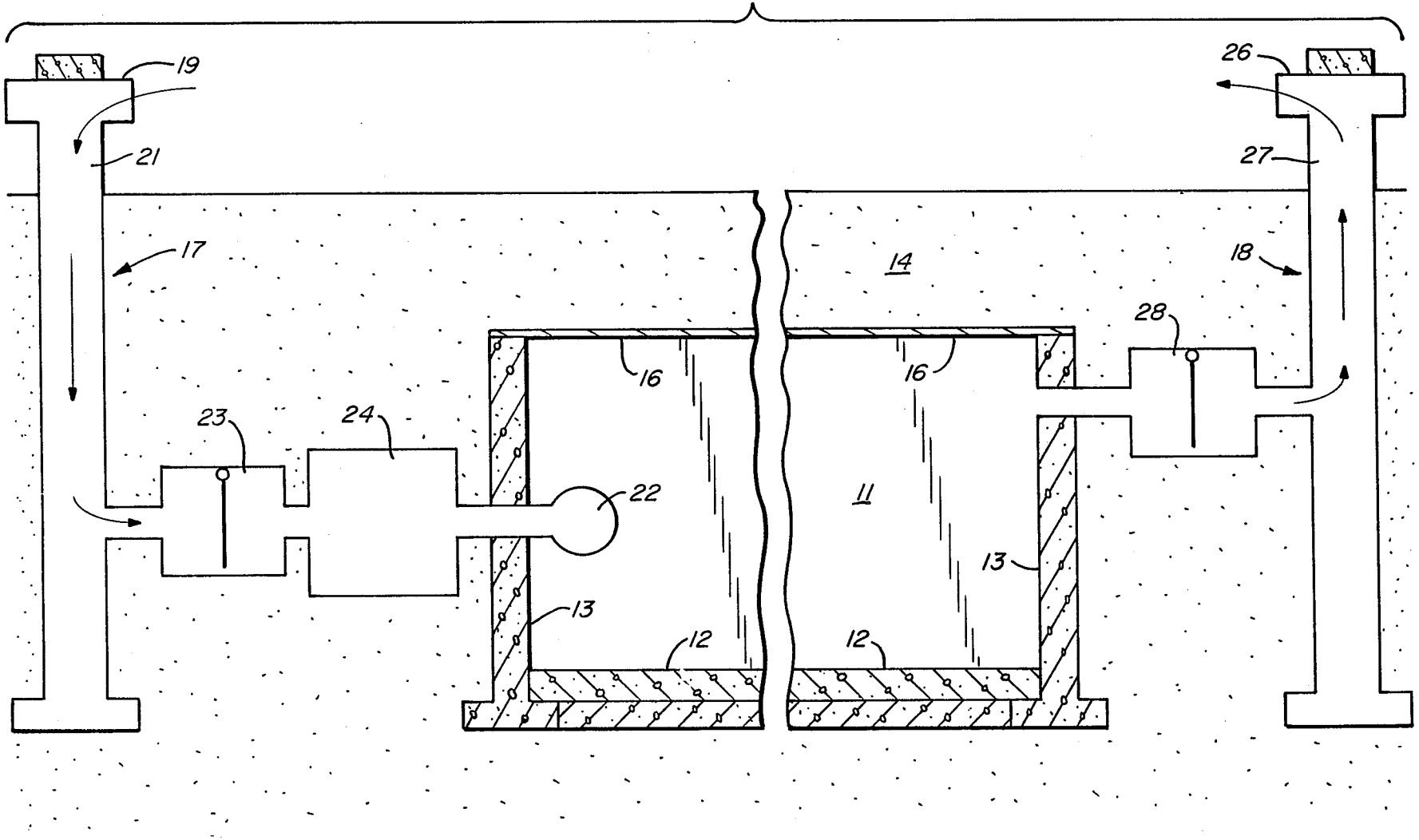
FIG. 1. (PRIOR ART)
FIG. 1 is a schematic drawing of a personnel shelter and associated ventilation system of the type for which the present invention is useful.

Referring to FIG. 1, a personnel shelter 11 having reinforced concrete floor 12 and walls 13 supports an earth cover 14 by a corrugated steel arch 16.

The shelter 11 is ventilated by a ventilation intake system 17 and ventilation discharge system 18. The intake system 17 includes an inlet 19 disposed above ground and providing a passageway for atmospheric air to enter into the main intake duct 21. A blower 22 draws air into the shelter from duct 21 through a pressure activated device 23 and a particulate filter 24.

The ventilation discharge system 18 includes an outlet 26 disposed above ground and providing a passageway through which air is discharged from the main discharge duct 27 which communicates with the interior of the shelter 11 through a pressure activated device 28. The pressure activated devices 23 and 28 effectively pneumatically seal the interior of the shelter for brief periods of time when the outside atmospheric pressure is highly elevated or greatly reduced as will occur during the aftermath of a nuclear explosion. These pressure activated devices, however, are not capable of protecting against a blast wave and in all likelihood would be destroyed as a result of a blast wave entering that far into the system. The inlet 19 and the outlet 26 are potential entry points for a blast wave and the present invention resides in a blast wave choke deployed within and around the inlet and outlet to prevent a blast wave from gaining access to the interior of the shelter 11 and causing damage to equipment and persons within.

Figure 2:
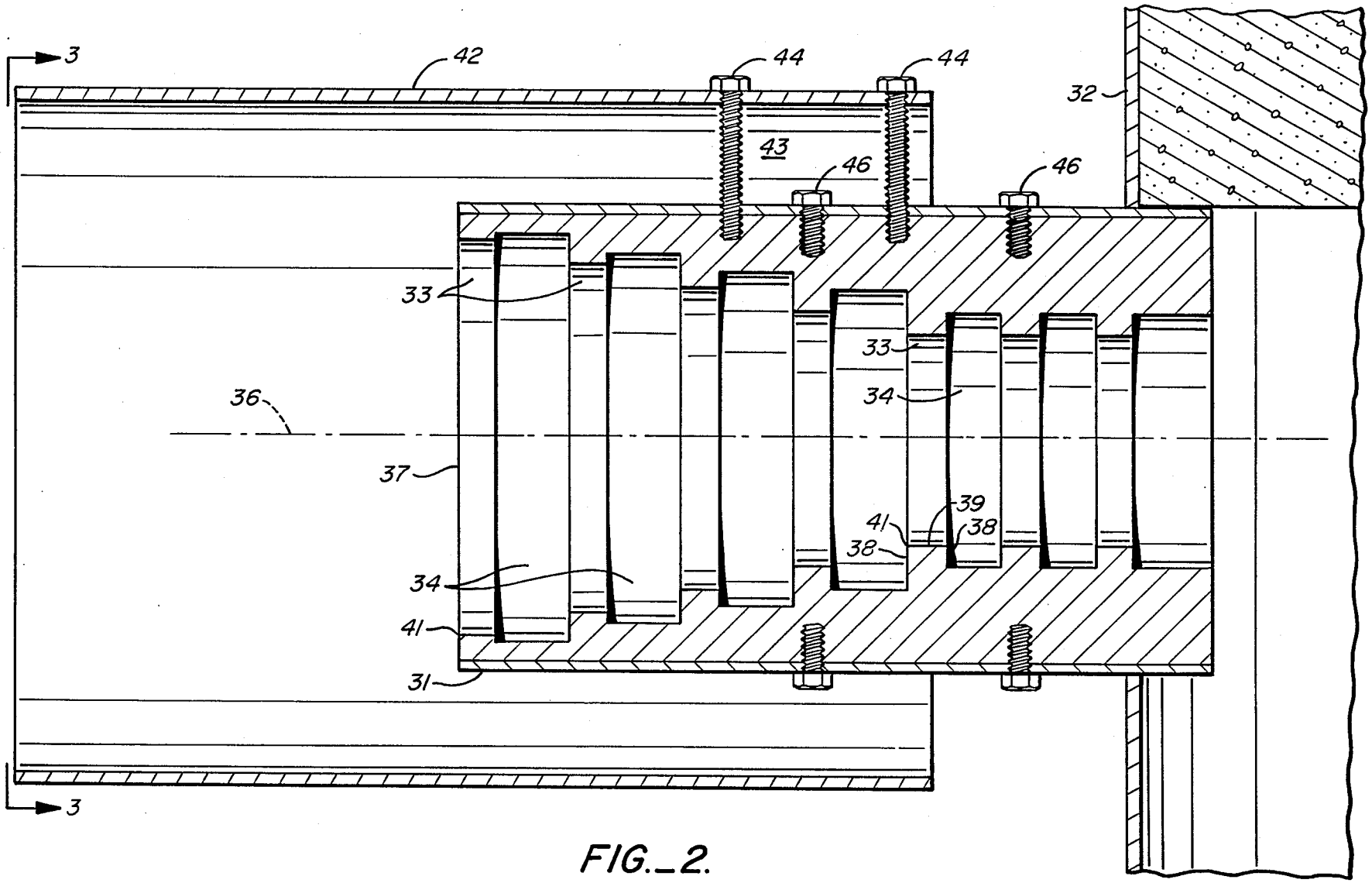
FIG. 2 is a side elevation of the blast deflector and choke elements of the present invention shown in section and in the environment of a ventilation intake system.
Figure 3:
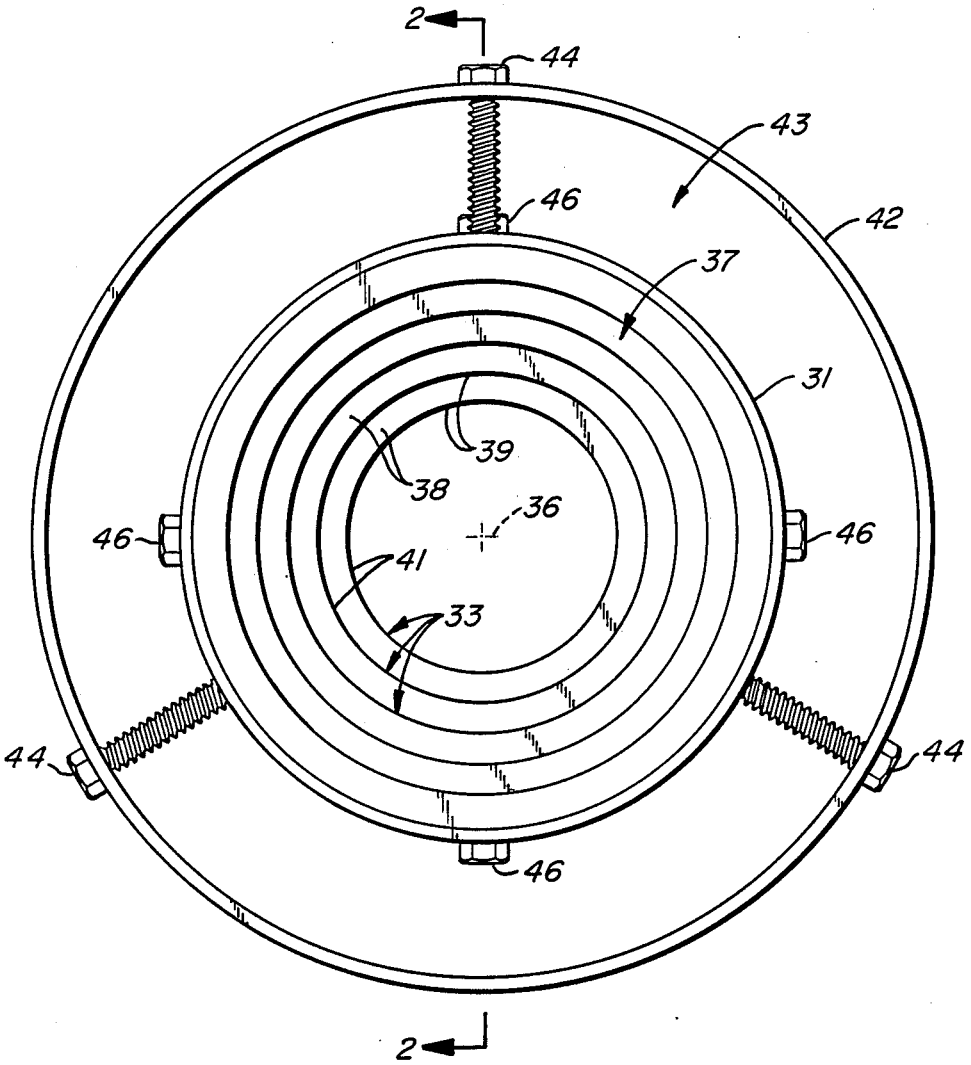
FIG. 3 is an end view of the invention.

Referring to FIGS. 2 and 3, a generally cylindrical inlet (or outlet) 31 extends laterally outward from a generally vertically disposed ventilation duct 32 which is in communication with the interior of a personnel shelter as described more fully above in connection with FIG. 1. Disposed within the inlet 31 are a plurality of annular choke elements 33 separated by a plurality of annular spacer elements 34 wherein the choke elements and spacer elements are all aligned along a common axis 36 which is also the axis of the cylindrical inlet 31. The interior or inside diameters of the choke elements 33 are progressively smaller as their distance increases from the opening 37 of inlet 31. By having four or five choke elements of progressively decreasing inside diameter, the desired interference wave will be established for any blast wave that enters the inlet and thus the remaining choke elements, if any, can be of the same inside diameter as the smallest choke element in the progression. It is, however, the set of progressively smaller choke elements that give rise to the primary interference patterns and thus provide the means by which enough energy in the blast wave is dissipated prior to its entering the interior of the ventilation system to render it harmless.

Each choke element 33 is defined by a pair of opposing radial walls 38 which lie in a plane generally parallel to the axis 36 and an intermediate axial interior surface 39 which is generally parallel to the axis 36 and thus at right angles to the surfaces 38. The surfaces 38 and 39 are joined by a relatively sharp circular edge 41. The circular edges 41 present a set of concentric circular edges (as best seen in FIG. 3) which interact with a blast wave to create the desired interference pattern by which the energy in the blast wave is dispelled. The blast wave is able to "see" each edge 41 as it attempts to travel down the inlet 31 by virtue of the fact that the inside diameter of each annular spacer element 34 is greater than the inside diameter of the annular choke element 33 to which it is immediately adjacent.

In order to deflect any choke wave not travelling substantially along the axis 36 a blast wave deflector in the form of an open-ended deflector cylinder 42 is disposed circumjacent the inlet 31 wherein a portion of the cylinder 42 surrounds a portion of the inlet 31 and choke elements 33 while a portion of the deflector 42 extends beyond the opening 37 of inlet 31. By having both ends of deflector cylinder 42 open and by providing an annular space 43 between the deflector cylinder 42 and the inlet 31, any blast wave that is established at one end of space 43 will be counteracted by a similar wave at the other end. Any blast wave approaching the inlet from a direction other than along the axis 36 will be at least partially deflected by the cylindrical deflector plate 42 and only the component along the axis 36 will need to be choked.

It is, of course, essential that all of the materials used to construct the various components of the invention described above be of sufficient strength to maintain integrity in the face of the expected blast wave with which the elements are to deal. The generally cylindrical deflector 42 and the generally cylindrical inlet 31 can for example be made of rolled steel plate with the duct 32 with which inlet 31 is intimately connected also made of rolled steel plate and combined with reinforced concrete for added protection. The deflector 42 can be mounted to the inlet 31 in a variety of known ways including the use of studs and bolts 44.

The choke elements 33 and spacer elements 34 must also be constructed from high strength materials and can be formed in individual pieces, in a single piece or in several components of choke elements and spacer elements unitarily formed. For example, a single cast iron insert forming the choke elements and spacer elements could be cast in a single piece and inserted into inlet 31 and secured there either by welding or mechanical fasteners 46. Alternatively, each choke element and each spacer element could be separately machined and inserted and fixed in place within inlet 31 to establish the series of concentric edges 41 giving rise to the desired interference pattern.

By way of example only and not as a limitation on the invention, the choke elements will effectively establish the desired interference pattern if the ratio of the area at the opening of the inlet 31 to the area defined by the diameter of the choke ring having the smallest inside diameter is approximately 3 to 1 and the inside diameter of each choke element in between is progressively smaller as the choke element is further from the opening 37.

What is claimed is:

1. A blast wave choke for an underground personnel shelter having a ventilation system including a generally cylindrical passageway between the interior of the shelter and the above ground atmosphere comprising in combination:

a plurality of annular choke elements of progressively smaller inside diameter disposed in the passageway so as to form a plurality of circular edges of different diameter whereby said choke elements cause an interference pattern to be established in any blast wave that enters the passageway.

2. The invention of claim 1 wherein said choke elements are aligned along a common axis and a plurality of said choke elements define circular edges of different diameters.

3. The invention of claim 1 wherein said choke elements are disposed in a portion of the ventilation system that is above ground.

4. The invention of claim 1 including a set of choke elements of substantially the same inside diameters.

5. The invention of claim 1 further comprising a plurality of annular spacer elements disposed between adjacent choke elements wherein each spacer element has a larger inside diameter than the inside diameter of the immediately adjacent choke elements.

6. The invention of claim 2 further comprising an annular spacer element disposed between adjacent choke elements wherein each spacer element has a larger inside diameter than the inside diameter of its immediately adjacent choke elements.

7. The invention of claim 6 wherein the choke elements have radial surfaces in planes generally perpendicular to the axis along which the choke elements are aligned.

8. The invention of claim 7 wherein each choke element has an interior axial surface generally parallel to the axis along which the choke elements are aligned.

9. The invention of claim 8 wherein said spacer elements each have an interior axial surface generally parallel to the interior axial surface of adjacent choke elements.

10. The invention of any of claims 2–9 further comprising a cylindrical blast deflector, open at both ends, a portion of which is disposed circumjacent the passageway and at least some of said choke elements and a portion of which extends beyond the end of the passageway, wherein the axis of said deflector is generally coincident with the common axis of said choke elements.

* * * * *